United States Patent [19]

Brockmanns et al.

[11] Patent Number: 4,738,097

[45] Date of Patent: Apr. 19, 1988

[54] FRICTION SPINNING DEVICE

[76] Inventors: Karl-Josef Brockmanns, Jakob-Krebs-Strasse 80, D-4156 Willich 2 - Anrath; Joachim Lünenschloss, Schloss-Schönau-Strasse 81, D-5100 Aachen, both of Fed. Rep. of Germany

[21] Appl. No.: 91,541

[22] Filed: Aug. 31, 1987

[30] Foreign Application Priority Data

Aug. 29, 1986 [DE] Fed. Rep. of Germany ..... 3629498

[51] Int. Cl.[4] ..... D01H 7/898; D01H 1/135

[52] U.S. Cl. ..... 57/401; 57/411; 57/413

[58] Field of Search ..... 57/400, 401, 408–413

[56] References Cited

U.S. PATENT DOCUMENTS

| | | | |
|---|---|---|---|
| 4,404,792 | 9/1983 | Parker et al. | 57/413 X |
| 4,567,722 | 2/1986 | Stahlecker | 57/413 X |
| 4,584,832 | 4/1986 | Stahlecker | 57/401 |
| 4,601,167 | 7/1986 | Fuchs | 57/401 |
| 4,607,485 | 8/1986 | Stahlecker | 57/408 X |
| 4,628,679 | 12/1986 | Stalder et al. | 57/413 X |
| 4,638,626 | 1/1987 | Stahlecker et al. | 57/401 |
| 4,640,089 | 2/1987 | Stalder et al. | 57/401 |
| 4,640,090 | 2/1987 | Lembeck | 57/401 |
| 4,649,699 | 3/1987 | Wurmli | 57/413 X |
| 4,672,804 | 6/1987 | Anahara et al. | 57/411 X |

FOREIGN PATENT DOCUMENTS

| | | |
|---|---|---|
| 3227401 | 4/1983 | Fed. Rep. of Germany . |
| 3322394 | 1/1985 | Fed. Rep. of Germany . |
| 3335065 | 4/1985 | Fed. Rep. of Germany . |
| 3502427 | 7/1986 | Fed. Rep. of Germany . |
| 3632889 | 5/1987 | Fed. Rep. of Germany . |

*Primary Examiner*—John Petrakes

*Attorney, Agent, or Firm*—Herbert L. Lerner; Laurence A. Greenberg

[57] ABSTRACT

A friction spinning device includes two drums being driven in the same direction and defining a wedge-shaped gap therebetween having a spinning region. A yarn draw-off device draws off yarn produced in the wedge-shaped gap in a given yarn draw-off direction. At least one of the drums is perforated and a suction device is disposed in the at least one drum and directed against the wedge-shaped gap. A fiber supply device has a fiber guide channel disposed at an angle relative to the given yarn draw-off direction. The fiber guide channel has substantially parallel side wall sections being mutually spaced apart by a given distance and the fiber guide channel has a slit-like fiber dispersion opening disposed in the wedge-shaped gap being delimited by the side wall sections and having a width substantially equal to the given distance. The fiber guide channel has a pipe-like enlargement at an end of the fiber dispersion opening being wider than the fiber dispersion opening. The pipe-like enlargement has an end in the form of an open pipe orifice joining the fiber dispersion opening in the wedge-shaped gap, and the open pipe orifice has a wall merging from the open pipe orifice into the side wall sections of the fiber guide channel.

3 Claims, 4 Drawing Sheets

FIG. 6
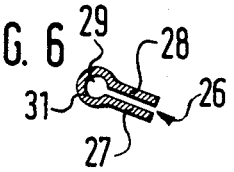
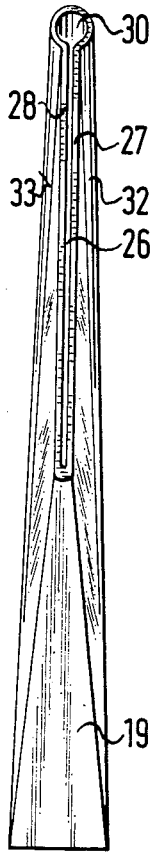
FIG. 5
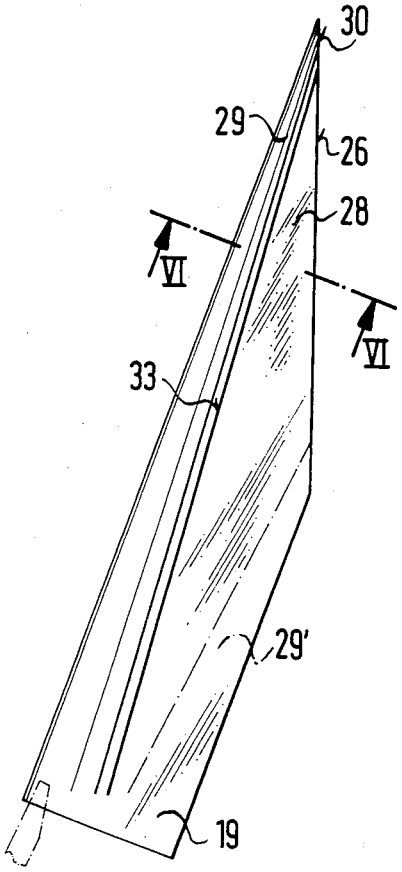
FIG. 4
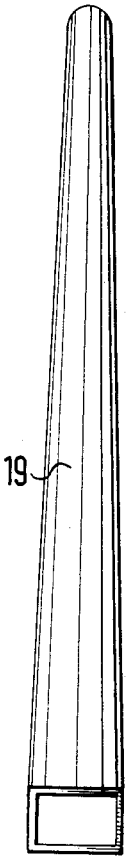
FIG. 3

FRICTION SPINNING DEVICE

The invention relates to a friction spinning device having two drums drivable in the same direction forming a wedge-shaped gap with a spinning region, at least one of the drums is perforated and has an interior suction device directed against the wedge-shaped gap, a fiber supply device having a fiber guide channel with a slit-like fiber dispersion opening disposed in the wedge-shaped gap, and a yarn draw-off device.

It is an object of the invention to provide a friction spinning device of the hereinafore-mentioned type wherein the yarn created in the spinning area is formed of a core component and a sheath component having wrapped fibers.

With the foregoing and other objects in view there is provided, in accordance with the invention, a friction spinning device, comprising two drums being drivable in the same direction and defining a wedge-shaped gap therebetween having a spinning region, a yarn draw-off device for drawing off yarn produced in the wedge-shaped gap in a given yarn draw-off direction, at least one of the drums being perforated, a suction device disposed in the at least one drum and directed against the wedge-shaped gap, a fiber supply device having a fiber guide channel disposed at an angle relative to the given yarn draw-off direction, the fiber guide channel having substantially parallel side wall sections being mutually spaced apart by a given distance and the fiber guide channel having a slit-like fiber dispersion opening disposed in the wedge-shaped gap being delimited by the side wall sections and having a width substantially equal to the given distance, the fiber guide channel having a pipe-like enlargement at an end of the fiber dispersion opening being wider than the fiber dispersion opening, the pipe-like enlargement having an end in the form of an open pipe orifice joining the fiber dispersion opening in the wedge-shaped gap, and the open pipe orifice having a wall merging from the open pipe orifice into the side wall sections of the fiber guide channel.

Thus the pipe-like enlargement of the channel does not constitute a foreign body in the fiber guide channel but is simply formed by means of a corresponding shaping of the fiber guide channel. The pipe-like enlargement of the channel is disposed on the side of the fiber guide channel facing away from the fiber dispersion opening when the yarn is drawn off against the direction of the supply of fibers. However, if the yarn is drawn off in the direction of the supply of fibers, the pipe-like enlargement of the channel can also be disposed on that side of the fiber guide channel having the fiber dispersion opening.

However, the direction of the draw-off of the yarn should in no case depend on which side of the fiber guide channel the pipe-like enlargement of the channel is located. Of course, the structure of the yarn depends on the direction in which it is drawn off and therefore the invention also makes it possible to produce differently structured yarn depending on which side of the fiber guide channel the pipe-like enlargement of the channel is located and depending on the side towards which the yarn is drawn off.

In accordance with another feature of the invention, the fiber guide channel has at least one air injection nozzle pointing into the pipe-like enlargement of the fiber guide channel. The injected air changes the flow conditions within the pipe-like enlargement of the channel, speeds up the transport of the fibers and assists in the stretching or elongation of the fibers. In addition, the flow in the direction of the fiber dispersion opening is also being influenced.

In accordance with a concomitant feature of the invention, the side walls of the fiber guide channel are wave-shaped in a direction transverse to a flow direction in the fiber guide channel, and the side walls have wave heights and lengths increasing as seen in a direction toward the fiber dispersion opening. Due to this feature, an increased stretching or elongation of the fibers takes place and lateral movement of the fibers through the fiber guide channel is increasingly prevented.

Other features which are considered as characteristic for the invention are set forth in the appended claims.

Although the invention is illustrated and described herein as embodied in a friction spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIGS. 3, 4 and 5 are elevational views of the fiber guide channel;

Figure 7:
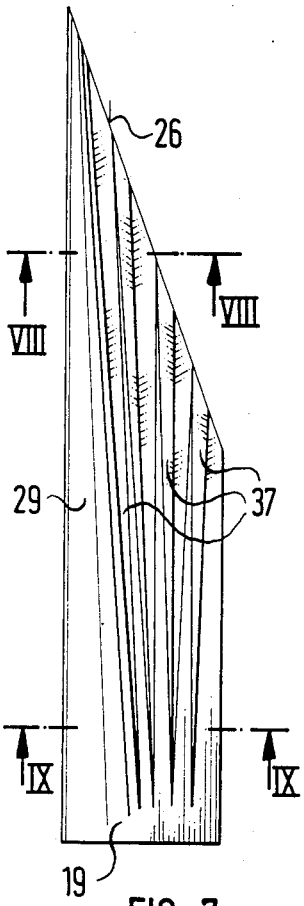
Figure 8:
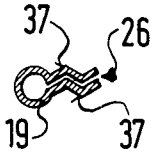
Figure 9:
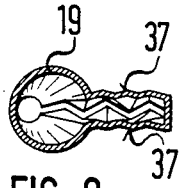

FIG. 6 is a cross-sectional view of the fiber guide channel taken along the line VI—VI of FIG. 4, in the direction of the arrows; and FIGS. 7 to 9 are views similar to FIGS. 4 and 6 showing alternative embodiments of the fiber guide channel with FIG. 8 being a section taken along the line VIII—VIII of FIG. 7 and FIG. 9 being a section taken along the line IX—IX of FIG. 7, in the direction of the arrows.

Figure 1:
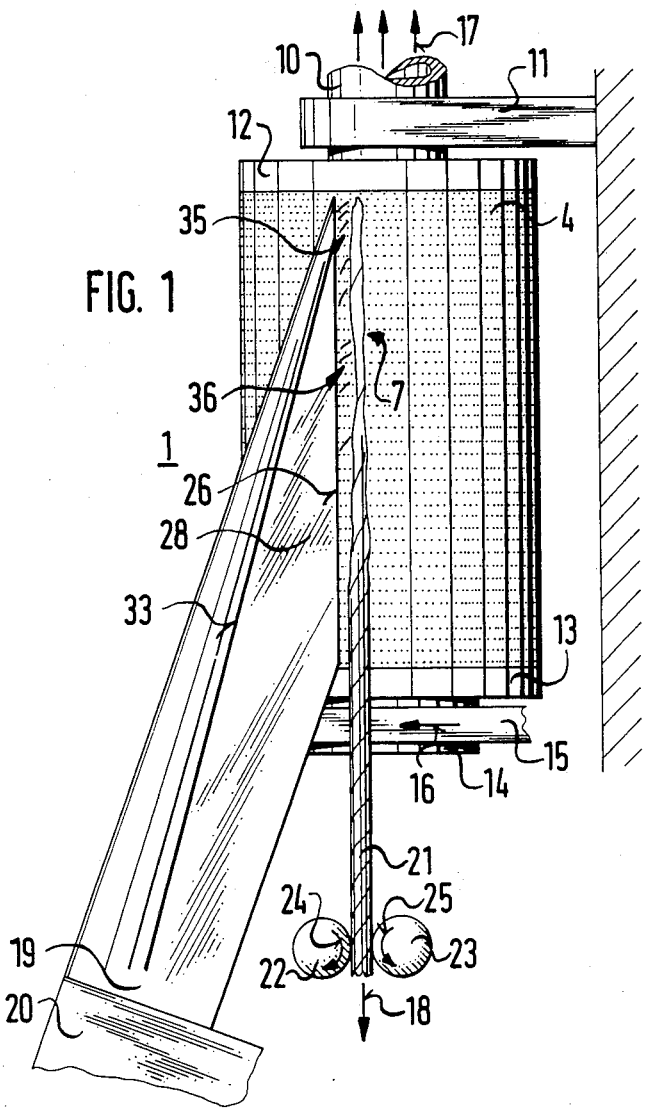
FIG. 1 is a fragmentary, diagrammatic, side-elevational view of a friction spinning device.
Figure 2:
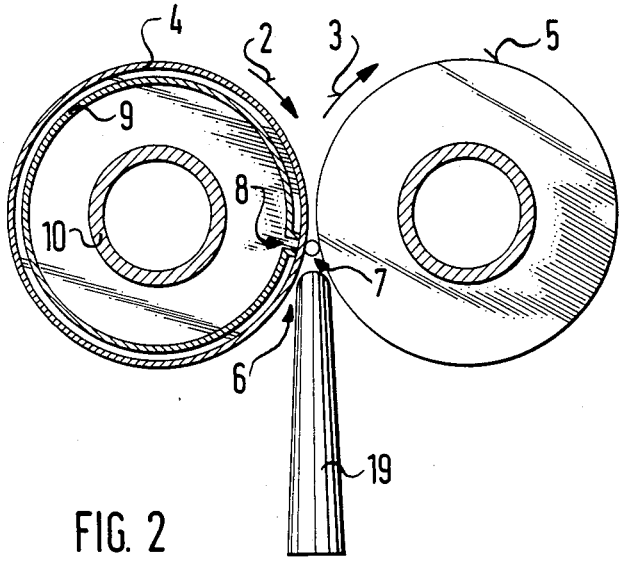
FIG. 2 is a partially cross-sectional view of the friction spinning device shown in FIG. 1.

Referring now to the figures of the drawings in detail and first, particularly, to FIGS. 1 and 2 thereof, there is seen a friction spinning device which has been designated as a whole by reference numeral 1. The friction spinning device has two perforated drums 4, 5 which are drivable in the same direction as shown by arrows 2, 3. The drums are located so close to each other that they form a wedge-like gap or spinning wedge 6 which has a spinning region 7.

Each of the two drums 4, 5 has a suction device in the interior thereof oriented in the direction of the wedge-shaped gap 6. For example and in accordance with FIG. 2, the drum 4 has a suction device 8 in the form of a slit extending parallel to the spinning region 7 in a stationary pipe 9 shown in section. The pipe 9 is connected to a suction pipe 10 which is firmly connected with the frame by means of a support 11. The suction pipe 10 supports a roller bearing 12 connected with the drum 4. The other end of the pipe 9 supports a roller bearing 13 which is also connected with the drum 4.

The outer ring of the roller bearing 13 shown in FIG. 1 is connected with a pulley 14 so that the drum 4 is drivable in the direction of an arrow 16 by means of a drive belt 15.

A corresponding configuration applies for the drum 5.

During the spinning process, air is sucked through the suction pipe 10 in the direction of an arrow 17 so that the spinning region 7 is supplied with air through the perforations in the drums 4, 5.

In accordance with FIG. 1, a fiber guide channel 19 which originates at a fiber supply device 20, is provided at an angle to yarn or thread draw-off the direction 18. Inside the fiber supply device 20, sliver, for example, is supplied and split into individual fibers. The individual fibers are transported through the fiber guide channel 19 to the spinning region 7. In the spinning region, a spun yarn or thread 21 is formed and is continuously drawn off parallel to the rotational axes of the drums 4, 5 by a yarn draw-off device 22, 23. The yarn draw-off device is formed of a continuously running drum 22 and a support roller 23 without its own drive which can be pressed against the drum 22 or the yarn or thread 21.

The driven drum 22 rotates in the direction of an arrow 24, and the following support roller 23 rotates in the direction of an arrow 25. FIGS. 1 and 3 to 6 particularly show that the fiber guide channel 19 has a unique shape in accordance with the invention. The fiber guide channel 19 has a slit-like fiber dispersion opening 26, which is located inside the wedge-shaped gap 6 in the vicinity of the spinning region 7, according to FIG. 1. The fiber dispersion opening 26 is delimited by side wall sections 27, 28 of the fiber guide channel 19. As shown in FIG. 6 in particular, the side wall sections 27, 28 located in the vicinity of the fiber dispersion opening 26 are spaced apart from each other by a distance approximately corresponding to the width of the fiber dispersion opening 26 and they are approximately parallel to each other. The fiber guide channel has a pipe-like enlargement 29 having a greater width than the fiber dispersion opening 26 on the side thereof facing away from the fiber dispersion opening 26.

Following the fiber dispersion opening 26, the enlargement 29 of the channel ends inside the wedge-shaped gap 6 in an open pipe orifice 30, which is especially visible in FIG. 5.

As FIG. 6 shows in particular, a wall 31 of the channel enlargement 29 is transformed at the pipe orifice 30 into the side wall sections of the fiber guide channel 19.

Since the fiber guide channel 19 has been formed of sheet metal by means of a stamping process, the shape or extent of the channel enlargement 29 is shown by beads 32, 33 visible from the outside.

FIG. 4 shows two alternative embodiments.

In the first alternative embodiment, the fiber guide channel 19 has an air injection nozzle 34 shown in phantom, which is directed into the channel enlargement 29.

In the second alternate embodiment, a pipe-like enlargement 29' of the channel is located on the side of the fiber guide channel 19 oriented toward the fiber dispersion opening 26.

Preferably, the channel enlargement 29' takes the place of the channel enlargement 29, although it can also be provided in addition to the channel enlargement 29 and the nozzle 34.

Referring to FIG. 1, the dispersion density of fibers 35 leaving the pipe orifice 30 is greater than the dispersion density of fibers 36 which exit across the extent of the fiber dispersion opening 26. The yarn or thread 21 which is created has spun core fibers and a sheath of wrapped fibers on top of the core fibers.

In the alternative embodiment of the fiber guide channel 19 according to FIG. 7, the side walls 37 are wave-like. The height and length of the waves increase in the direction toward the fiber dispersion opening 26.

FIG. 8 is a section taken along the line VIII—VIII of FIG. 7 and FIG. 9 is a section along the line IX—IX of FIG. 7. These sectional views show that there is a considerable increase of the height and the length of the waves of the side walls 37 in the direction of the fiber dispersion opening 26 and finally that peaks and troughs of the waves are opposite each other. The waves can be formed by stamping and the fiber guide channel 19 can be formed with two halves. The connecting points are suggested by points in the sectional views.

We claim:

1. Friction spinning device, comprising two drums being driven in the same direction and defining a wedge-shaped gap therebetween having a spinning region, a yarn draw-off device for drawing off yarn produced in said wedge-shaped gap in a given yarn draw-off direction, at least one of said drums being perforated, a suction device disposed in said at least one drum and directed against said wedge-shaped gap, a fiber supply device having a fiber guide channel disposed at an angle relative to said given yarn draw-off direction, said fiber guide channel having substantially parallel side wall sections being mutually spaced apart by a given distance and said fiber guide channel having a slit-like fiber dispersion opening disposed in said wedge-shaped gap being delimited by said side wall sections and having a width substantially equal to said given distance, said fiber guide channel having a pipe-like enlargement at an end of said fiber dispersion opening being wider than said fiber dispersion opening, said pipe-like enlargement having an end in the form of an open pipe orifice joining said fiber dispersion opening in said wedge-shaped gap, and said open pipe orifice having a wall merging from said open pipe orifice into said side wall sections of said fiber guide channel 2. Friction spinning device according to claim 1, wherein said fiber guide channel has at least one air injection nozzle pointing into said pipe-like enlargement of said fiber guide channel.

3. Friction spinning device according to claim 1, wherein said side walls of said fiber guide channel are wave-shaped in a direction transverse to a flow direction in said fiber guide channel, and said side walls have wave heights and lengths increasing as seen in a direction toward said fiber dispersion opening.

* * * * *